United States Patent [19]

Economy et al.

[11] 4,207,408

[45] * Jun. 10, 1980

[54] HIGH TENACITY PHENOLIC RESIN FIBERS

[75] Inventors: James Economy, Eggertsville; Francis J. Frechette, Tonawanda; Luis C. Wohrer, Lewiston, all of N.Y.

[73] Assignee: The Carborundum Company, Niagara Falls, N.Y.

[ * ] Notice: The portion of the term of this patent subsequent to Feb. 13, 1990, has been disclaimed.

[21] Appl. No.: 908,481

[22] Filed: May 22, 1978

Related U.S. Application Data

[63] Continuation of Ser. No. 460,636, Apr. 12, 1974, abandoned, which is a continuation of Ser. No. 255,858, May 22, 1972, abandoned, which is a continuation-in-part of Ser. No. 149,045, Jun. 1, 1971, abandoned.

[51] Int. Cl.[2] ..... C08G 8/10; C08G 8/28

[52] U.S. Cl. ..... 525/503; 264/176 F; 525/505; 525/508; 528/481; 528/502

[58] Field of Search ..... 528/130, 131, 165, 481, 528/502; 525/503, 505, 508; 264/176 F

[56] References Cited

U.S. PATENT DOCUMENTS

| | | | |
|---|---|---|---|
| 2,091,965 | 9/1937 | Cherry | 528/165 X |
| 2,101,642 | 12/1937 | Elbel et al. | 528/165 X |
| 2,212,509 | 8/1940 | Cherry | 528/165 X |
| 2,376,511 | 5/1945 | Saunders et al. | 264/210 F |
| 3,088,794 | 5/1963 | Bonner | 264/343 |
| 3,650,102 | 3/1972 | Economy et al. | 528/165 |
| 3,651,199 | 3/1972 | Blume et al. | 528/165 |
| 3,716,521 | 2/1973 | Economy et al. | 528/165 |
| 3,848,044 | 11/1974 | Hagiwara et al. | 264/347 X |

*Primary Examiner*—Walter C. Danison
*Attorney, Agent, or Firm*—David E. Dougherty; Raymond W. Green

[57] ABSTRACT

Infusible cured phenolic resin fibers of the present invention have a birefringence of at least $2\times10^{-3}$ with the x-ray diffraction pattern of the fibers showing an amorphous halo. The tenacity of infusible cured phenolic resin fibers is significantly increased by subjecting the fibers to sufficient longitudinal tension as to cause at least about 30% elongation of the fibers. The Young's modulus of elasticity of the fibers is also significantly increased thereby. Preferably the resulting stretched infusible cured phenolic resin fibers have a tenacity of at least about 4 g./den.

7 Claims, 11 Drawing Figures

HIGH TENACITY PHENOLIC RESIN FIBERS

CROSS REFERENCES TO RELATED APPLICATIONS

This is a continuation of application Ser. No. 460,636, filed Apr. 12, 1974, which was a continuation of application Ser. No. 255,858, filed May 22, 1972; which was a continuation-in-part of application Ser. No. 149,045, filed June 1, 1971, now all abandoned.

BACKGROUND OF THE INVENTION

The present invention relates to a method of increasing the tenacity and Young's modulus of elasticity of infusible cured phenolic resin fibers and to the improved fibers produced thereby.

Phenolic resins are too well-known in the art to require more than a very brief description here. Extensive discussions of phenolic resins may be found, for example, in A. A. K. Whitehouse et al, *Phenolic Resins*, American Elsevier Publ. Co., Inc., New York (1968), and Gould, *Phenolic Resins*, Reinhold Publ. Corp., New York (1959).

Phenolic resins are produced by the condensation of a phenol and an aldehyde. The phenol employed is most commonly phenol itself, but any of a wide variety of phenols as well as mixtures thereof may be used, such as phenol which is substituted in the ortho, meta, and/or para position, provided that sufficient ortho and para positions are unsubstituted to permit condensation and cross-linking. Similarly, various aldehydes have been employed, formaldehyde being by far the most commonly used. Accordingly, many different varieties of phenolic resins are commercially available.

Phenolic resins are generally classified as either resoles or novolacs. Resoles are ordinarily prepared by carrying out the condensation with a molar excess of the aldehyde and in the presence of an alkaline catalyst. Resoles are characterized by the presence therein of methylol groups, which render it possible to effect curing and cross-linking via methylene linkages by heat alone. Novolacs are usually prepared by employing an acid catalyst and a slight molar excess of the phenol. Novolacs are characterized by the absence of methylol groups, and accordingly, they cannot be cured and cross-linked by heat alone, additionally requiring the presence of a source of methylene groups and preferably a suitable catalyst.

Infusible cured phenolic resin fibers are a comparatively recent development in the history of phenolic resins. They are ordinarily produced by fiberizing a melt of a phenolic resin, as by melt spinning or by blowing (i.e., allowing a thin stream of the melt to fall into the path of a blast of a gas such as air which fiberizes the stream), to obtain fusible uncured phenolic resin fibers which are subsequently treated to cure, or cross-link, the resin at least to the point of infusibility. When the phenolic resin selected is a resole, such curing is effected merely by heating. When the phenolic resin selected is a novolac, curing is effected by heating in the presence of a source of methylene groups such as hexamethylenetetramine, paraformaldehyde or formaldehyde, and preferably also in the presence of an acidic or basic catalyst, hexamethylenetetramine being rather unique in being able to serve as both a methylene group source and a basic catalyst. A particularly desirable method for the preparation of infusible cured novolac fibers is described in U.S. patent application Ser. No. 710,292, filed Mar. 4, 1968 by James Economy et al, now U.S. Pat. No. 3,650,102, which is commonly assigned with the present application, and the disclosure of which is incorporated herein by reference. Fibers may also be prepared from mixtures of resoles and novolacs in any desired proportions, the curing conditions being selected with regard to the proportions. Additives and modifiers, either reactive or non-reactive, may be incorporated in the phenolic resin to alter its fiberization characteristics and/or the properties of the fibers.

Infusible cured phenolic resin fibers have a number of highly desirable properties which render them of value in numerous applications. Perhaps their most important virtue is their outstanding flame resistance. When subjected to a flame, the fibers, being infusible, do not melt, but rather char to produce carbon fibers which continue to retain the shape and approximate dimensions of the original fibers and which continue to afford extremely effective protection from flames. Accordingly, the fibers are of potentially great utility in the fabrication of flame protective clothing, as well as drapes, carpeting, upholstery and the like which are especially suited to use in areas where fire constitutes a particular hazard. Such fibers also provide very effective thermal and acoustical insulation, and again, they are particularly useful in these applications in areas where fire is a hazard.

Infusible cured phenolic resin fibers produced as described above are somewhat susceptible to oxidation, particularly at elevated temperatures. Just after curing, they are generally quite intensely colored, the hue ranging from fairly deep pink to red, sometimes with a somewhat orange cast; and upon standing, particularly if exposed to light and air, the coloration increases considerably in intensity, becoming deep orange, orange-red, or brownish-red; that is, the fibers possess rather poor colorfastness. It has recently been discovered that infusible cured phenolic resin fibers which are white and which have markedly improved colorfastness and oxidation resistance may be produced by blocking at least about 50%, and preferably at least about 90%, of the phenolic hydroxyl groups of the cured resin in the fibers by etherification or, preferably, esterification. This blocking of the phenolic hydroxyl groups has little or no effect upon the tenacity or Young's modulus of elasticity of the fibers. Infusible cured phenolic resin fibers wherein the phenolic hydroxyl groups of the cured resin are blocked and methods for the production thereof constitute the subject matter of U.S. patent application Ser. No. 130,017, filed Mar. 31, 1971 by James Economy et al, now U.S. Pat. No. 3,716,521, entitled ETHERIFIED OR ESTERIFIED PHENOLIC RESIN FIBERS AND PRODUCTION THEREOF which is commonly assigned with the present application and the disclosure of which is incorporated herein by reference. Blocking is readily carried out by reacting the infusible cured phenolic resin fibers with any of a wide variety of suitable esterification or etherification reagents whereby the hydrogen atoms of the phenolic hydroxyl groups are replaced and the phenolic hydroxyl groups are blocked by esterification or etherification. Suitable reagents include anhydrides of carboxylic acids, acylation with anhydrides of lower alkanoic acids being preferred, especially acetylation with acetic anhydride. Other suitable reagents include, for example, acid halides such as acetyl chloride, diethylsulfate, and dimethylsulfate.

Notwithstanding their desirable attributes, the utility of blocked and unblocked infusible cured phenolic resin fibers has heretofore been somewhat limited by their relatively poor mechanical properties, in particular, their relatively low tenacity and, to a lesser extent, their relatively low Young's modulus of elasticity. Such fibers typically have a tenacity in the range from about 1 to about 2 g./den., thus being strong enough to be suitable for certain applications but somewhat too weak for certain other applications. For example, fabrics produced from such fibers tend to have relatively poor strength and wear characteristics due to the relatively low tenacity of the fibers. Accordingly, infusible cured phenolic resin fibers having a somewhat higher tenacity would be highly desirable, from the standpoint of broadening the range of end use applications and of producing stronger fabrics capable of better wear performance. An increased Young's modulus of elasticity would also be beneficial in these respects.

SUMMARY OF THE INVENTION

This invention relates to infusible cured phenolic resin fibers having a birefringence of at least $2\times10^{-3}$, the x-ray diffraction pattern of said fibers substantially showing an amorphous halo.

Fibers composed of an infusible cured resin and having a birefringence of at least $2\times10^{-3}$ with their x-ray diffraction pattern substantially showing an amorphous halo have not been known previously.

As will be described later, the fibers of this invention can be produced by subjecting infusible cured phenolic resin fibers to a longitudinal tension to cause a permanent elongation in the fibers.

In accordance with the present invention, the tenacity of an infusible cured phenolic resin fiber, wherein the phenolic hydroxyl groups of the cured resin may either be blocked or unblocked as described above, is increased by subjecting the fiber to sufficient longitudinal tension as to cause at least about 30% permanent elongation of the fiber. In short, the starting cured phenolic resin fiber is stretched longitudinally to a length at least about 30% longer than its original length. In addition to increasing the tenacity of the fiber, such stretching also increases its Young's modulus of elasticity.

In order to effect a significant improvement in the tenacity and Young's modulus of elasticity, it has been found that an elongation of at least about 30% is required, this degree of stretching usually resulting in an increase of the order of about 50% in each of these properties. A greater extent of stretching is preferred, most preferably the maximum amount of stretching possible without fiber breakage, since the tenacity and usually the Young's modulus of elasticity tend to increase with increasing extent of elongation. Elongations of 100% and more have been achieved, which is quite remarkable in view of the cross-linked structure of the cured phenolic resin. Infusible cured phenolic resin fibers having a tenacity greater than 6 g./den. and a Young's modulus of elasticity of about 75 g./den. have been produced. It is preferred that the stretched fibers have a tenacity of at least about 4 g./den. for good strength and wear resistance.

Most conveniently, the stretching is carried out at room temperature, using any suitable means to effect the requisite longitudinal tension. Accordingly, the fibers to be stretched should preferably have a break elongation of more than about 30% at room temperature. However, fibers having a somewhat lower break elongation may nonetheless be elongated more than 30% by carrying out the stretching with the fibers at a temperature in the range from about 100° C. to about 300° C., the fibers being softened by the heat and their break elongation thus being increased to 30% or more. Alternatively, the break elongation of such fibers may be increased to 30% or more by treating them with a polar organic liquid, which diffuses into the fibers and softens and swells them. The stretching may be carried out either while the fibers are immersed in liquid, or after they have been treated with the liquid to swell them but before drying them and thus restoring them to the non-swollen state. Such heating or swelling with a polar liquid may also be employed advantageously in many cases even if the starting fibers have a break elongation greater than 30%, to increase the break elongation and thus permit a greater extent of stretching. Heating is generally preferred to swelling with a polar liquid, the latter method requiring the additional step of drying the stretched fibers.

DESCRIPTION OF PREFERRED EMBODIMENTS

Figure 1C:
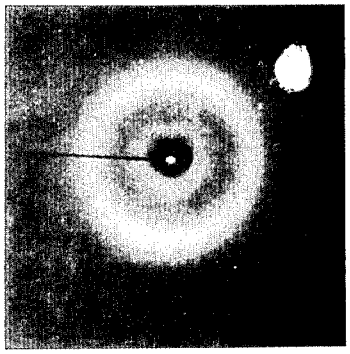
FIG. 1 shows the x-ray diffraction patterns of unblocked infusible cured phenolic resin fibers of this invention, (a) referring to undrawn fibers, (b) to 30% drawn fibers, and (c) to 60% drawn fibers.

The invention will now be described partly with reference to the following examples, which are intended to illustrate, and not to limit the scope of, the invention.

EXAMPLE 1

A novolac is prepared conventionally by condensing formaldehyde with a slight molar excess of phenol in the presence of a catalytic amount of oxalic acid. After purification to remove any particulate impurities and residual phenol, the resin has a number average molecular weight of about 850. The resin is fiberized, i.e., formed into fibers, by melt spinning, 38 filaments being simultaneously drawn from a melt at 146° C. through a spinnerette having 38 circular orifices 0.25 mm. in diameter, at a rate of 790 m./min. As the filaments are drawn, they are gathered together to form a 38-strand continuous multifilament yarn which is wound up on a revolving polypropylene spool.

38 g. of the fibers on the spool are immersed in 2 l. of an aqueous curing solution containing 18% paraformaldehyde as a source of methylene groups and 18% HCl as a catalyst, at room temperature (about 25° C.). The solution is heated to 40° C. over a period of 4 hours, then to 60° C. over a period of 1 hour, then to the boiling point (103° C.) over a period of 1 hour, and the temperature is held at the boiling point for 1 hour, whereupon the fibers are removed, washed with water, and dried in air at about 60° C.

A length of a single fiber is removed from the resulting infusible cured phenolic resin fiber yarn. The fiber has a denier of 1.0, a break elongation greater than 70%, a tenacity of 1.7 g./den. and a Young's modulus of elasticity of 42 g./den. A portion of the fiber about 5 cm. in length is mounted on a tensioning device comprising holding means adjacent one end of the fiber and tensioning, or pulling, means adjacent the other end, the length of fiber between these means being 2.54 cm. This 2.54 cm. length of fiber is then subjected to sufficient longitudinal tension as to stretch it to a permanent length of 4.31 cm., an elongation of 70%. While the unstretched fiber has a birefringence of about 0, the stretched fiber has a birefringence of about $15\times10^{-3}$. The stretched portion of the fiber has a denier of 0.6, a break elongation of 26%, a tenacity of 6.1 g./den. and a Young's modulus of elasticity of 74 g./den. In addition to the marked increase in tenacity and Young's modulus of elasticity, it will be noted that the break elongation is decreased by the stretching. Nonetheless, it is quite remarkable that the fiber still has a break elongation as high as 26% after such extensive stretching, and in general, it is found that stretched fibers produced according to the invention retain a sufficiently high break elongation as to be suitable for most conventional types of textile processing.

EXAMPLE 2

Another portion of the same fiber subjected to stretching in Example 1 and having the same properties as set forth in Example 1 is stretched in the same manner as in Example 1 from a length of 2.54 cm. to 3.30 cm., an elongation of 30%. The stretched fiber has a denier of 0.9, a tenacity of 3.6 g./den., a Young's modulus of elasticity of 50 g./den., and a break elongation of 39%. It is thus seen that an elongation of 30% effects a significant increase in tenacity and Young's modulus of elasticity, although not as much of an increase as is effected by the greater extent of elongation in Example 1.

EXAMPLE 3

The same phenolic resin as employed in Example 1 is fiberized by melt spinning as in Example 1. Approximately 30 g. of the fibers are cured in a solution of the same composition as that employed in Example 1 by immersing the fibers in the solution at room temperature, heating the solution to 40° C. over a period of 2 hours, then heating the solution to the boiling point over a period of 1.5 hours and holding the temperature at the boiling point for 2 hours, whereupon the fibers are removed, washed with water and dried in air at about 60° C. The resulting infusible cured phenolic resin fibers, in the form of a 38-strand continuous multifilament yarn, have an average denier of 1.7, an average tenacity of 1.9 g./den., an average Young's modulus of elasticity of 42 g./den., and a break elongation ranging from about 25% to about 42% and averaging 35%.

A short length of the 38-strand yarn is mounted in a tensioning device with a 5.1 cm. length between the holding and the tensioning means being susceptible to tensioning. The fibers are heated to about 200° C. and then stretched to a length of 6.7 cm., an elongation of 31%. No breakage of the fibers occurs, thus it is evident that the break elongation of those fibers having a break elongation less than 31% at room temperature is increased to more than 31% by heating to 200° C. After cooling to room temperature, the stretched fibers have an average denier of 1.4, an average tenacity of 3.0 g./den., an average Young's modulus of elasticity of 67 g./den., and an average break elongation of 22% and a birefringence of at least about $4\times10^{-3}$.

EXAMPLE 4

Another portion of the same 38-strand infusible cured phenolic resin fiber yarn subjected to stretching in Example 3, and having the same properties as set forth in Example 3, is stretched in the same manner and at the same temperature as described in Example 3 but to a length 50% longer than the original length instead of only 31%. The resulting stretched fibers have an average denier of 1.3, an average tenacity of 4.0 g./den., an average Young's modulus of elasticity of 67 g./den., and an average break elongation of 20% and a birefringence of at least about $4\times10^{-3}$, again illustrating by comparison with Example 3 the greater increase in tenacity which is effected by a greater degree of elongation.

EXAMPLE 5

The same phenolic resin as employed in Example 1 is fiberized as in Example 1, and curing is effected as in Example 3, to produce a 38-strand continuous multifilament yarn of infusible cured phenolic resin fibers having an average denier of 1.7, an average tenacity of 1.9 g./den., an average Young's modulus of elasticity of 42 g./den., and break elongation ranging from about 25% to about 42% and averaging 35%. A portion of the yarn approximately 30 cm. in length and having a 20.3 cm. long segment marked off is immersed in dimethylformamide at 152° C., near the boiling point, whereby the fibers are swelled almost immediately. It is preferred that the polar swelling liquid be hot since heat accelerates the swelling action, less than 10 seconds being required for swelling in the present instance. The yarn is removed from the dimethylformamide after about 10 seconds and the excess liquid is allowed to drain off. The yarn, still wet with dimethylformamide and swollen, is mounted on a tensioning device and the 20.3 cm. segment is stretched to a length of 26.4 cm., an elongation of of 30% and a birefringence of at least about $4\times10^{-3}$. The fibers are dried in vacuum at 100° C. for 16 hours while still being held under tension in the tensioning device to prevent shrinkage of the fibers during the drying. The resulting stretched fibers have an average denier of 1.4, an average tenacity of 3.0 g./den., an average Young's modulus of elasticity of 70 g./den., and an average break elongation of 23%.

EXAMPLE 6

The same phenolic resin as employed in Example 1 is fiberized as in Example 1, and curing is effected as in Example 3 except that the fibers are held at the boiling point of the curing solution for only 0.5 hour instead of 2 hours. The resulting infusible cured phenolic resin fibers, in the form of a 38-strand continuous multifilament yarn, are rather deep reddish-pink.

20 g. of the yarn is immersed in a mixture of 2 l. of acetic anhydride and 1 ml. of 98% sulfuric acid at room temperature, and the mixture is heated to boiling (about 138° C.). The yarn is left in the boiling mixture for 5 min., then removed, washed with acetone and dried in air at about 60° C. A yield of 25.6 g. of fibers is obtained, representing a weight gain of 28%, which, as compared to the theoretical weight gain for complete acetylation of the phenolic hydroxyl groups of the resin, indicates that about 70% of the phenolic hydroxyl groups of the resin are blocked by acetylation. The resulting fibers are white, have an average denier of 1.7, an average tenacity of 1.6 g./den., an average Young's modulus of elasticity of 37 g./den., and a break elongation ranging from about 20% to about 50% and averaging 31%.

A portion of the yarn approximately 25 cm. long is swelled with hot dimethylformamide as in Example 5 and then subjected to stretching and drying as in Example 5, a 15.2 cm. segment of the yarn being elongated to 19.8 cm., an elongation of 30%. While the unstretched fiber has a birefringence of about 0, the stretched fiber has a birefringence of about $17\times10^{-3}$. The resulting stretched fibers have an average denier of 1.5, an average tenacity of 2.7 g./den., an average Young's modulus of elasticity of 56 g./den., and an average break elongation of 23%.

EXAMPLE 7

A novolac is prepared conventionally by condensing formaldehyde with a slight molar excess of phenol in the presence of a catalytic amount of oxalic acid. The novolac was purified to remove impurities, and the resulting novolac had a number average molecular weight of about 980. The novolac was melted at 155° C., and spun through a spinnerette having 18 circular orifices with a diameter of 0.4 mm., followed by wind-up on a revolving spool at a rate of 1000 m./min. The uncured resin fibers had a tenacity of 0.15 g./den., an elongation of 0.5% and a Young's modulus of elasticity of 35 g./den.

The resulting fibers were immersed in an aqueous curing bath containing 18% formaldehyde and 15% hydrochloric acid, and the temperature was gradually raised to about 103° C. in 4 hours. The fibers were further cured for 5 hours at this temperature, washed with water, and then dried in air at about 60° C. The resulting fibers had a denier size of 3.0, a tenacity of 1.4 g./den., an elongation of 63%, a Young's modulus of elasticity of 33 g./den., and a birefringence of 0, exhibiting infusibility.

The resulting cured phenol resin fibers were drawn at various draw ratios in a 55% aqueous solution at 55° C. in the same way as in Example 1. The results are shown in Table 1.

Table 1

| Draw Ratio (%) | Denier Size | Tenacity (q./den.) | Elongation (%) | Young's Modulus (q./den.) | Birefringence |
|---|---|---|---|---|---|
| 0 | 3.0 | 1.4 | 63 | 33 | 0 |
| 20 | 2.8 | 1.5 | 40 | 43 | $10\times10^{-3}$ |
| 30 | 2.6 | 1.6 | 31 | 48 | $15\times10^{-3}$ |
| 40 | 2.4 | 1.7 | 26 | 52 | $19\times10^{-3}$ |
| 60 | 2.1 | 2.1 | 12 | 61 | $28\times10^{-3}$ |

Figure 1B:
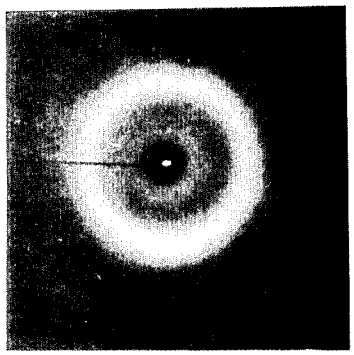
Figure 1A:
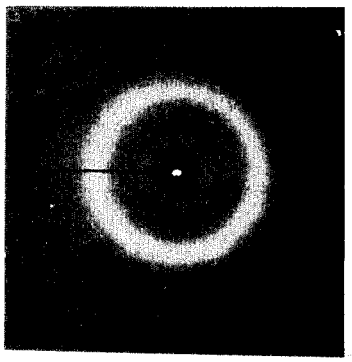
Figure 3:
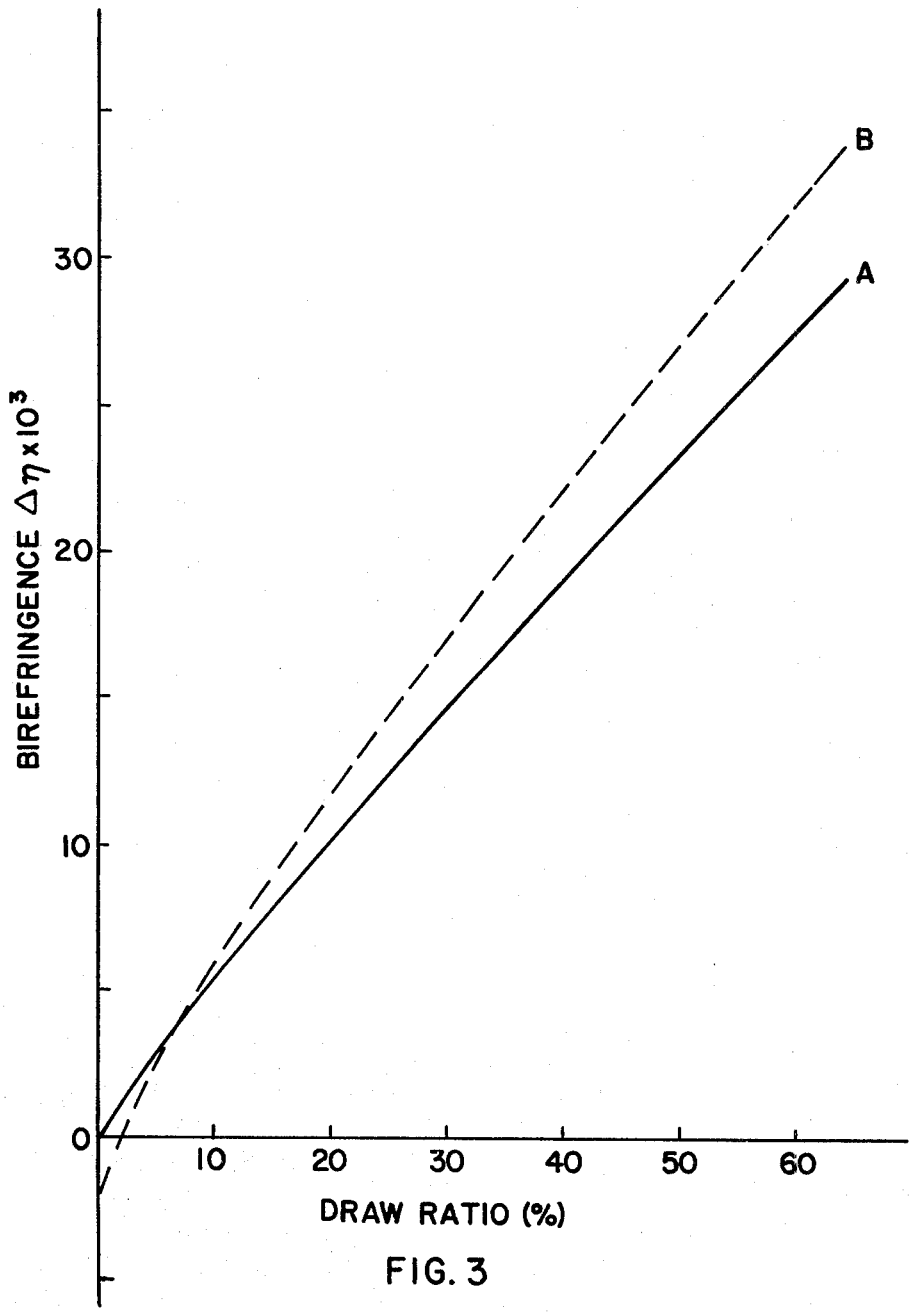
FIG. 3 shows the relation between the draw ratio and the birefringence of the fibers of this invention, A and B corresponding respectively to the fibers in FIGS. 1 and 2 above.
Figure 4:
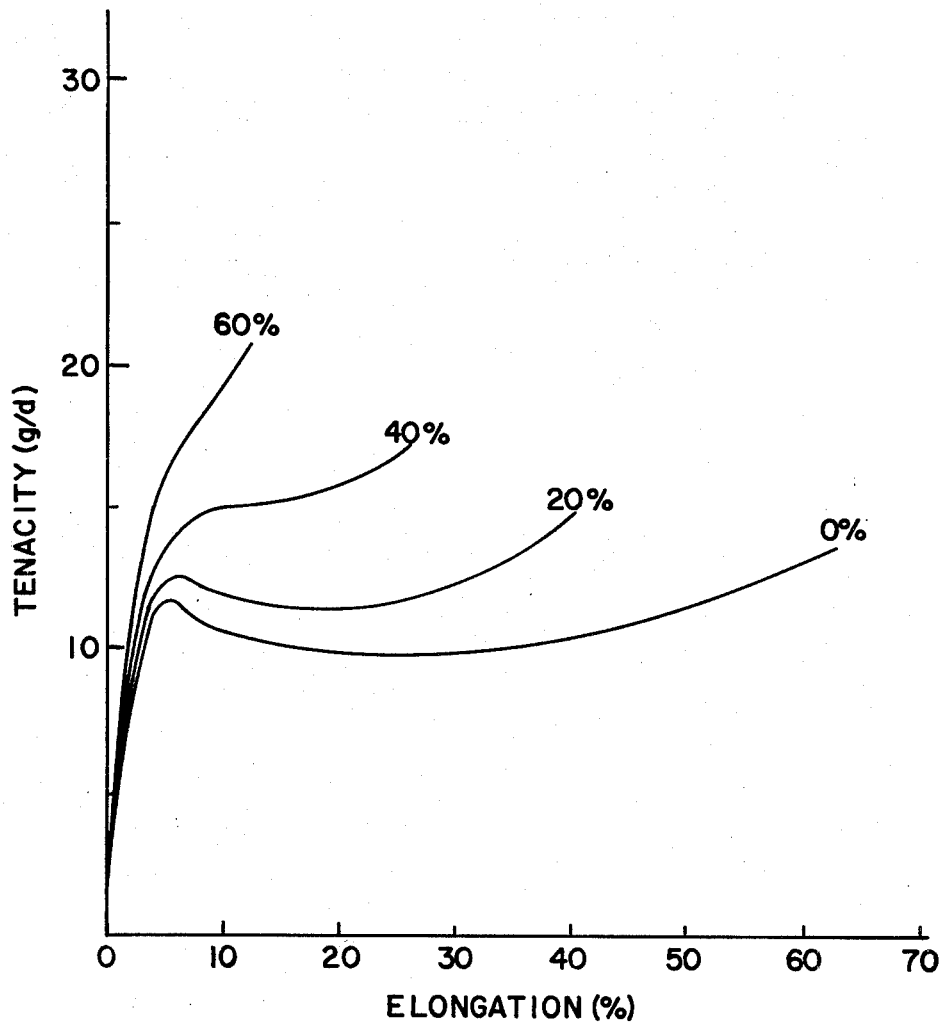
FIGS. 4 and 5 show the tenacity-elongation curves of two examples of the fibers of this invention which were drawn at various draw ratios.

The x-ray diffraction patterns of the fibers drawn by 0.30, and 60% are shown in FIGS. 1*a*, 1*b*, and 1*c*. Cu-K$\alpha$ rays were used as the x-ray, and the photographs were taken with a distance between dry plates being adjusted to 45 mm. The relation between the draw ratio and the birefringence of the resulting fibers is shown in FIG. 3(A). The tenacity-elongation curve of the fibers drawn at different draw ratios is shown in FIG. 4, and the Young's modulus of elasticity of the resulting fibers is shown in FIG. 7(A).

EXAMPLE 8

The fibers obtained in Example 7 after curing and washing were immersed in a solution at 20° C. containing 90% acetic anhydride, 9% dimethylformamide and 1% sulfuric acid, and in this state, the temperature was raised to 135° C. in 30 minutes. At this temperature, the fibers were heated for 30 minutes. Then, the fibers were withdrawn, allowed to cool and washed first with acetone and then with water, followed by drying in air at about 60° C. The resulting fibers had a denier size of 3.7, a tenacity of 1.2 g./den., an elongation of 48%, a Young's modulus of elasticity of 18 g./den., a birefringence of $-2\times10^{-3}$, and an esterification degree of 58%, exhibiting infusibility. These fibers were drawn at various draw ratios in the same way as shown in Example 7. The results are shown in Table 2.

Table 2

| Draw Ratio (%) | Denier Size | Tenacity (q./den.) | Elongation (%) | Young's Modulus (q./den.) | Birefringence |
|---|---|---|---|---|---|
| 0 | 3.7 | 1.2 | 48 | 18 | $-2\times10^{-3}$ |
| 10 | 3.6 | 1.2 | 29 | 23 | $6\times10^{-3}$ |
| 20 | 3.4 | 1.4 | 23 | 27 | $12\times10^{-3}$ |
| 40 | 3.0 | 1.5 | 18 | 33 | $23\times10^{-3}$ |
| 60 | 2.6 | 1.8 | 10 | 38 | $32\times10^{-3}$ |

Figure 2C:
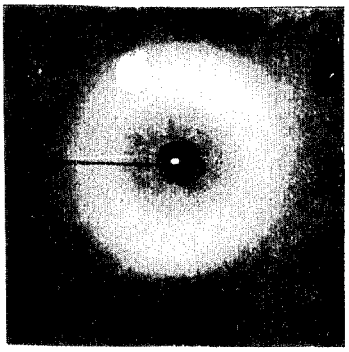
FIG. 2 shows the x-ray diffraction patterns of blocked infusible cured phenolic resin fibers of this invention, (a) referring to undrawn fibers, (b) to 20% drawn fibers, and (c) to 40% drawn fibers.
Figure 2B:
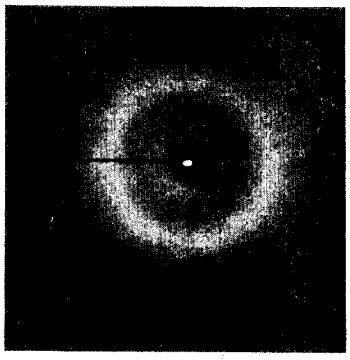
Figure 2A:
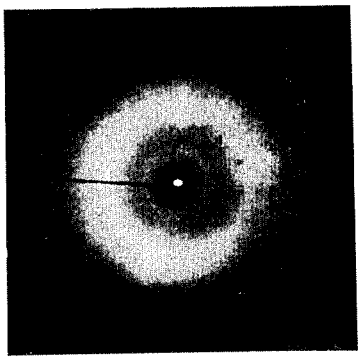

The x-ray diffraction patterns of the fibers drawn by 0, 20 and 40% are shown in FIGS. 2*a*, 2*b* and 2*c*. The relation between the draw ratio and the birefringence of the resulting fibers is shown in FIG. 3(B), and the relation between the Young's modulus and the draw ratio is shown in FIG. 7(B).

EXAMPLE 9

The procedure of Example 7 was repeated except that the take-up speed was changed to 1200 m./min. The fibers obtained were immersed in an aqueous curing bath containing 18% formaldehyde and 15% hydrochloric acid at room temperature, and the temperature was raised to about 103° C. in 6 hours. The fibers were heated further at this temperature for 2 hours to cure them, followed by washing with water, and then drying in air at about 60° C. The infusible cured phenol resin fibers obtained (denier size 2.1) were drawn at various draw ratios in boiling water in accordance with the procedure set forth in Example 1. The tenacity-elongation curve of each of the fibers obtained is shown in FIG. 5, from which it is seen that an increase in tenacity is remarkable with an increase in draw ratio.

The behavior of the infusible cured phenolic resin fibers by drawing is very characteristic unlike the case of the conventional thermoplastic synthetic resin fibers. The behavior is that by the drawing of the fibers at a low draw ratio such as less than 100% of the original length of the undrawn fibers, the tenacity and Young's modulus of the fibers increase abruptly. The behavior of the tenacity-elongation curve of such low ratio drawn fibers is very different from that of the conventional one.

Figure 5:
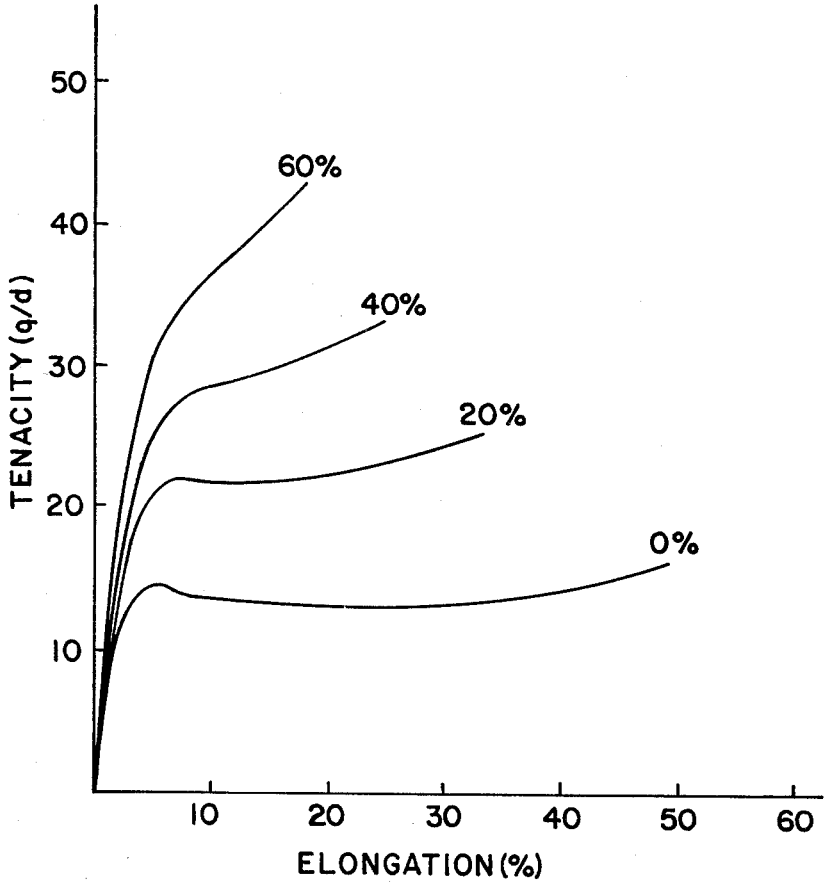
Figure 6:
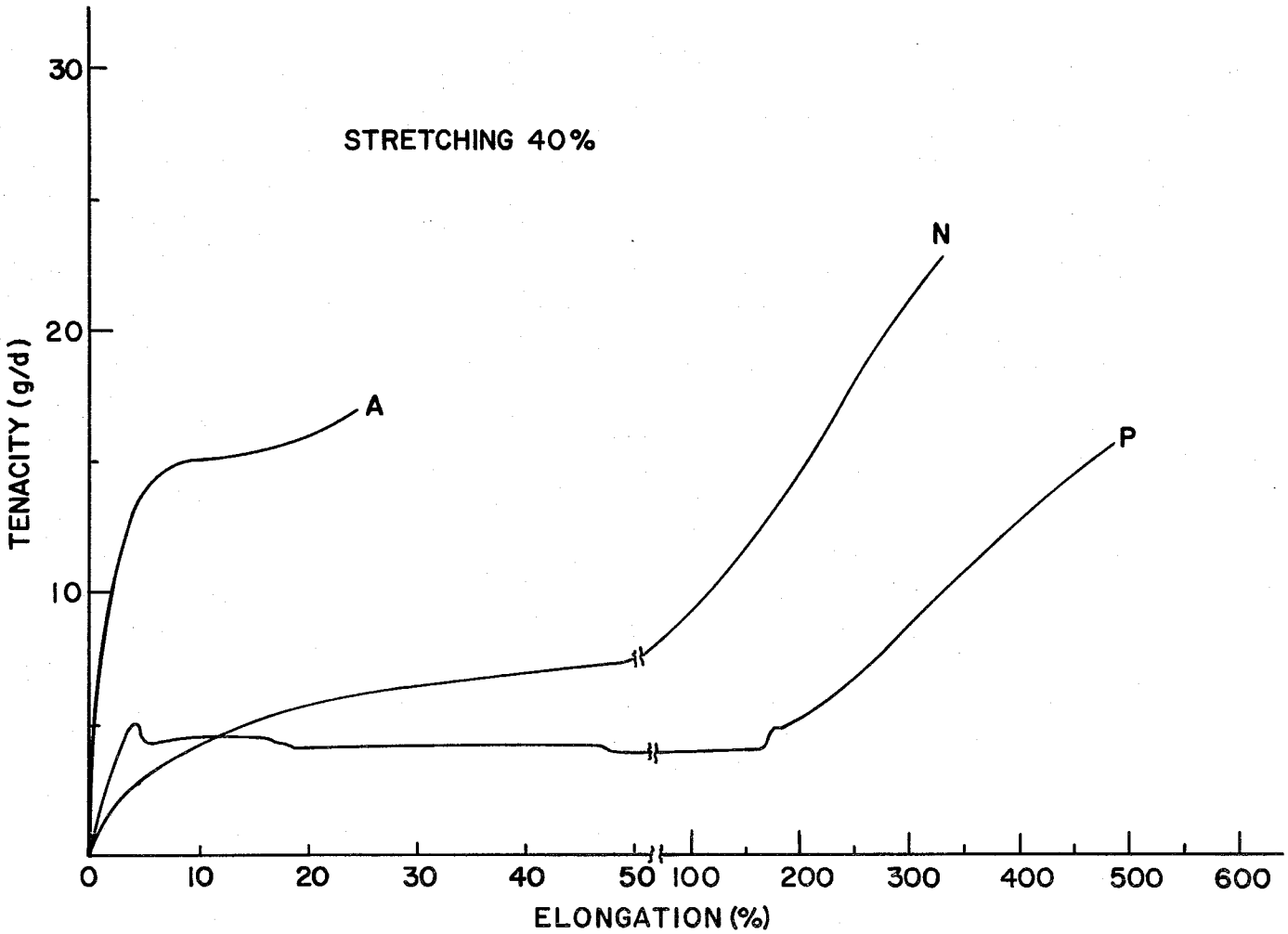
FIG. 6 shows the tenacity-elongation curves of the fibers of this invention (A), 6-nylon fibers (N) and polyethylene terephthalate fibers (P) which were drawn by 40%, the latter two being for comparative purposes.

The tenacity-elongation curve of the fibers of this invention is illustrated in FIG. 4 (Example 7) and FIG. 5 (Example 9). The percentages on the curves show the draw ratio. It is seen from these drawings that according to a rise in the draw ratio, the increase in tenacity is remarkable. FIG. 6 illustrates the tenacity-elongation curve of the 40% drawn fibers of this invention, 40% drawn 6-nylon fibers and polyethylene terephthalate fibers. These drawings clearly indicate the uniqueness of the fibers of this invention drawn at a low draw ratio.

Figure 7:
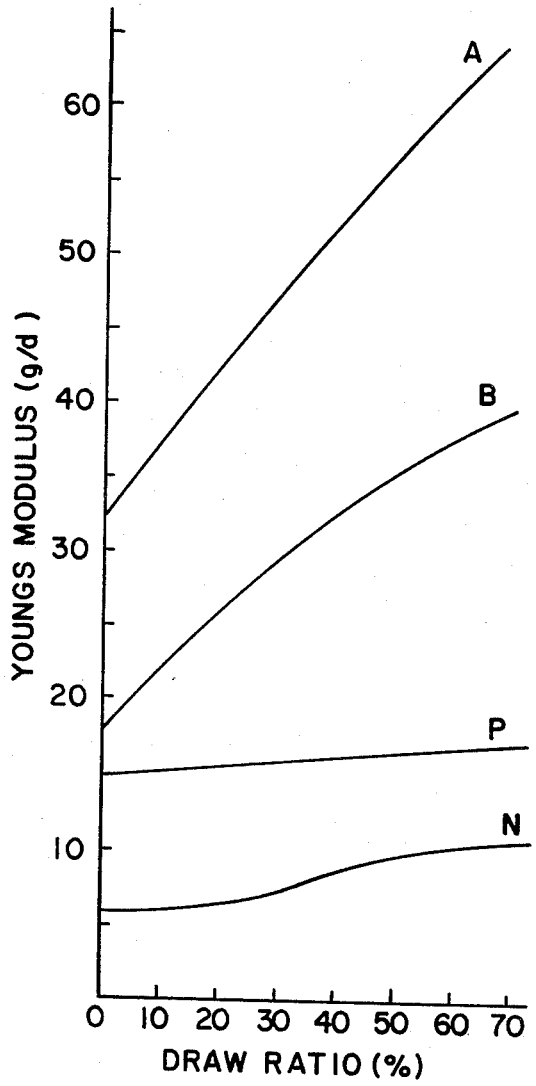
FIG. 7 shows the relation between the draw ratio and the Young's modulus, (A) referring to the fibers of this invention derived from unblocked phenolic resin, and (B) to the fibers of this invention derived from blocked phenolic resin, and (P) and (N) respectively referring to polyethylene terephthalate fibers and 6-nylon fibers for comparative purposes.

A rise in Young's modulus by drawing at a low ratio is shown in FIG. 7. In the drawing, (A) indicates unblocked phenolic resin fibers (Example 7), (B) concerns blocked phenolic resin fibers (Example 8), and (P) and (N) respectively, relate to polyethylene terephthalate fibers and 6-nylon fibers for comparative purposes. By drawing at a low ratio below 100%, the Young's modulus of the conventional synthetic resin fibers rise only very slightly, whereas that of the infusible cured phenolic resin fibers rises abruptly. Generally speaking, blocked infusible cured phenolic resin fibers in their undrawn state have a lower Young's modulus than those blocked, and an increase in Young's modulus to be brought about by drawing is to a slight extent.

In the drawing process, the infusible cured phenolic resin fibers do not undergo necking as is generally seen in the drawing of polyethylene terephthalate fibers.

As described above, the fibers of this invention can be produced by drawing infusible cured phenolic resin fibers thereby to cause a permanent elongation. These fibers are infusible and substantially amorphous and have a birefringence of at least $2\times10^{-3}$. Furthermore, these fibers have higher tenacity and Young's modulus than undrawn raw fibers.

The fibers of this invention have a tenacity of at least 1.3 g./den., usually 1.4 g./den. Depending upon the state of drawing, the e fibers could have a tenacity of 3.5 to 4.0 g./den. The Young's modulus of the fibers of this invention is at least 35 g./den., preferably 40 g./den., at times 70 g./den. or more when the phenolic hydroxyl groups of the resin are not blocked, and at least 20 g./den., preferably at least 25 g./den., at times 40 g./den. or more when the phenolic hydroxyl groups are blocked. The Young's modulus of 35 g./den. or less is sufficiently feasible. These physical properties can be obtained by drawing by about 5% to 100%, or more, for example 120% to 150% or more without attendent breakage.

Since the fibers of this invention possess the abovementioned properties, they have superior utility as materials for producing various fibrous properties for protection of flame. These various products are suitable for use in which the risk of flame is within a certain range. Furthermore, these fibers have superior insulating properties against heat and sound, and therefore proves effective for use in such application in which the risk of flame is within a certain range.

Since it is preferred that the infusible cured phenolic resin fibers to be stretched have a break elongation greater than about 30%, it is generally desirable, during the production of the fibers, to control, insofar as possible, such conditions as are known to affect this property of the fibers. For example, surface imperfections can markedly reduce the break elongation of the fibers, and care is indicated in the mechanical handling of the fibers during the various steps of their production to minimize the introduction of such imperfections. The break elongation of the fibers also tends to decrease with increasing degree of cross-linking in the cured fibers, which is a function of the curing conditions employed. While the resin must, of course, be cured at least to the point of infusibility, unnecessarily extensive curing and cross-linking is preferably avoided. For purposes of the invention, infusible cured novolac fibers are very much preferred over other types of infusible cured phenolic resin fibers, not only because it has proven to be somewhat more convenient to cure novolacs than resoles in fibrous form, but also because it is considerably easier to control the extent of curing and cross-linking. It is indeed remarkable that fibers of cured phenolic resins can be stretched appreciably, in view of the cross-linked structure of the cured resin. On the other hand, uncured phenolic resin fibers cannot be stretched appreciably, having a very low break elongation and being much too weak and fragile.

An increased break elongation is also favored by comparatively uniform curing and cross-linking throughout the thickness of the fibers. When novolac fibers are employed, such curing is dependent upon the diffusion of the methylene group source and the catalyst throughout the thickness of the fibers, and such comparatively uniform curing and cross-linking is thus most readily obtainable with relatively fine fibers. From this standpoint, the maximum diameter of the novolac fibers is preferably about 25 microns, although much thicker novolac fibers up to several hundred microns in diameter or more may be employed for purposes of the invention.

It will be apparent that stretching may be carried out in accordance with the invention on a single fiber or simultaneously on a plurality of fibers, as in the examples, and that while the stretching is effected in a batchwise fashion in the examples, it may be carried out in a continuous manner with suitable apparatus. For purposes of continuous stretching, a continuous multifilament yarn is preferably employed as the starting fiber material, although a single continuous filament may be employed, if desired, as may also a yarn of staple fibers, the longer the staple fibers the better to minimize slippage between the fibers during tensioning. Provision may be made in such a continuous stretching process for heating the fibers or swelling them with a polar liquid, if desired.

Suitable organic liquids to effect softening and swelling of the infusible cured phenolic resin fibers include various polar liquids, and the greater their polarity, the more effectively they swell the fibers. Accordingly, such very highly polar liquids as dimethylacetamide and dimethylformamide are especially preferred, dimethylsulfoxide being effective but somewhat more hazardous to handle. Tetramethyl urea and hexamethyl phosphoramide are other examples of liquids which are particularly useful.

In marked contrast to fibers of aliphatic or aromatic polyamides or of polyesters such as polyethylene terephthalate, the stretching of infusible cured phenolic resin fibers apparently does not produce crystallinity with the fibers. However, while unstretched cured phenolic resin fibers generally are not birefringent, they exhibit birefringence after stretching when observed under a microscope with polarized light, the extent of birefringence increasing with increasing degree of stretching. This birefringence may be interpreted as an indication that stretching tends to orient the polymer chains in the direction of the longitudinal axis of the fiber.

Tenacity, break elongation and Young's modulus of elasticity values set forth herein are determined in substantial accordance with A.S.T.M. Designation D2101-64T, denier being determined in accordance with A.S.T.M. Designation D1577-60T. Percentages set forth herein are by weight except as otherwise stated or indicated by the context as in the case of break elongation values and percent elongation.

While the invention has been described herein with reference to certain examples and preferred embodiments, it is to be understood that various changes and modifications may be made by those skilled in the art without departing from the concept of the invention, the scope of which is to be determined by reference to the following claims.

What is claimed is:

1. An infusible cured phenolic resin fiber having a birefringence of at least $2\times10^{-3}$ with an x-ray diffraction pattern of the fibers showing an amorphous halo, wherein at least about 50% of the phenolic hydroxyl groups of said resin are blocked.

2. A fiber as set forth in claim 1 having a birefringence of at least $4\times10^{-3}$.

3. A fiber as set forth in claim 2 having a birefringence of at least $6\times10^{-3}$.

4. A fiber as set forth in claim 1 wherein said cured phenolic resin is a cured novolac.

5. A fiber as set forth in claim 1 wherein said fiber has been subjected to tension to cause at least about 30% permanent elongation at a temperature in the range from about 100° C. to about 300° C.

6. A fiber as set forth in claim 1 wherein said fiber is subjected to said tension while said fiber is swelled by a polar organic liquid.

7. A fiber as set forth in claim 1 comprising a cured phenolic resin fiber having a tenacity of at least about 4 g./den.

* * * * *